US006824441B1

(12) United States Patent
Wiggs et al.

(10) Patent No.: US 6,824,441 B1
(45) **Date of Patent: *Nov. 30, 2004**

(54) TOY WITH MOVING CHARACTER

(75) Inventors: Christopher Charles Wiggs, London (GB); Christopher Joseph Crabtree Taylor, London (GB)

(73) Assignee: Origin Products Ltd., London (GB)

( * ) Notice: Subject to any disclaimer, the term of this patent is extended or adjusted under 35 U.S.C. 154(b) by 0 days.

This patent is subject to a terminal disclaimer.

(21) Appl. No.: 09/495,093

(22) Filed: Feb. 1, 2000

Related U.S. Application Data

(63) Continuation of application No. 09/141,271, filed on Aug. 27, 1998, now abandoned.

(30) Foreign Application Priority Data

Aug. 29, 1997 (GB) ..... 9718164

(51) Int. Cl.[7] ..... A63H 33/26
(52) U.S. Cl. ..... 446/136; 446/135
(58) Field of Search ..... 446/489, 135, 446/136, 137, 138

(56) References Cited

U.S. PATENT DOCUMENTS

| | | | | | |
|---|---|---|---|---|---|
| 1,323,232 | A | | 11/1919 | Page | 446/135 |
| 2,036,076 | A | | 3/1936 | Philippi | 446/135 |
| 2,138,367 | A | | 11/1938 | Bonanno | 446/358 |
| 2,673,421 | A | | 3/1954 | Leonard | 446/136 |
| 3,126,670 | A | * | 3/1964 | Smith | 273/442 |
| 3,377,067 | A | * | 4/1968 | Proietti | 446/136 X |
| 3,481,071 | A | | 12/1969 | Hinkson | 446/135 |
| 3,638,357 | A | | 2/1972 | Groh | 446/136 X |
| 3,785,648 | A | | 1/1974 | Kobayashi | 273/85 B |
| 3,823,941 | A | * | 7/1974 | Ochi et al. | 463/61 |
| 3,946,520 | A | | 3/1976 | Goldfarb et al. | 446/135 |
| 4,012,040 | A | | 3/1977 | Fernandes | 273/85 A |
| 4,124,950 | A | | 11/1978 | Becker | 446/286 |
| 4,189,864 | A | | 2/1980 | Saito | 446/471 X |
| 4,556,396 | A | | 12/1985 | Kennedy et al. | 446/462 X |
| 4,834,371 | A | | 5/1989 | Hay et al. | 273/85 B |
| 4,878,878 | A | | 11/1989 | Bittner | 446/330 X |
| 5,417,605 | A | | 5/1995 | Chan | 446/136 |
| 5,618,233 | A | | 4/1997 | Iimura et al. | 463/67 |
| 5,890,944 | A | | 4/1999 | Wiggs et al. | 466/135 |
| 5,897,419 | A | * | 4/1999 | Suganuma | 446/285 |
| 5,976,019 | A | * | 11/1999 | Ikeda et al. | 463/61 |
| 6,056,619 | A | | 5/2000 | Wiggs et al. | 446/135 |
| 6,062,938 | A | * | 5/2000 | Meng-Suen | 446/134 |
| 6,102,767 | A | | 8/2000 | Wiggs et al. | 446/135 |
| 6,193,581 | B1 | | 2/2001 | Wiggs et al. | 446/330 |
| 6,206,746 | B1 | | 3/2001 | Wiggs et al. | 446/135 |

FOREIGN PATENT DOCUMENTS

| | | | | |
|---|---|---|---|---|
| DE | 873003 | | 4/1953 | 446/135 |
| FR | 1072548 | | 9/1954 | 446/135 |
| FR | 1112934 | | 11/1955 | 446/135 |
| FR | 1111975 | | 3/1956 | 446/135 |
| FR | 2333410 | | 7/1977 | 446/444 |
| GB | 2315423 A | * | 2/1998 | |
| GB | 2315424 A | * | 2/1998 | |
| GB | 2328622 A | * | 3/1999 | |

* cited by examiner

*Primary Examiner*—Derris H. Banks
*Assistant Examiner*—Dmitry Suhol
(74) *Attorney, Agent, or Firm*—Woodard, Emhardt, Moriarty, McNett & Henry LLP

(57) ABSTRACT

The invention relates to a toy comprising a surface along which an article is moved, in one embodiment, by the use of magnetic attraction between a movable magnet or magnetic material under the surface, and the article. The invention relates to the provision on the article of a movable portion, such as, a leg or a wheel the movement of which is driven by the movement of the article along the surface. The movable portions can be utilized to add to the realism and/or control of the article as it moves along the surface and/or can be used to move a component or portion of the article as the same moves along the surface, or, by the use of stored energy device the component can be moved when the article has stopped moving along the surface and the movement of the component adds to the appeal of the article.

16 Claims, 3 Drawing Sheets

TOY WITH MOVING CHARACTER

REFERENCE TO RELATED APPLICATION

This application is a continuation of U.S. patent application Ser. No. 09/141,271, filed Aug. 27, 1998, now abandoned and entitled: "Article with Movement Means" which is incorporated by reference in its entirety.

BACKGROUND OF THE INVENTION

The invention which is the subject of this application relates to a toy comprising an article for movement along a playbase, means for controlling the article and said article including further means for imparting a second movement on the same. The toy is for use, typically by a child by manipulating the control means to cause movement of the article along the playbase and in turn movement within or on the article itself. The article to be moved can be a scaled version of any of a human, animal or machine and the playbase can be shaped to define an environment or series of environments in which the child would expect to find the article in real life, thus adding to the realism.

One known toy with a control means for controlling the movement of an article along a playbase is disclosed in Patent Application No.9710939.1 in which the control means and article both include at least one magnet therein such that when the article and control means are placed in proximity, with the playbase intermediate, a magnetic field is created which is of sufficient strength so as to cause the article to "follow" the movement of the control means when powered. The control means includes a portion which is exposed to be moved by the child and said movement is translated by a pantograph arrangement to cause linear movement of the housing in which the magnet is contained.

A problem with this known type of control means and article is that the article itself has no means for generating movement of components of the article so that the article conventionally moves along the playbase with an inanimate appearance.

SUMMARY OF THE INVENTION

The aim of the invention is to provide means to cause an article to move along a playbase and to provide movement means as part of the article so that as the article moves along the playbase, the means on the article also move. Yet further it is an aim to have the article movement caused and actuated by the movement of the article along the playbase. These aims allow further realism and animation to the toy by causing the article to move both under the influence of the magnetic field and to have an additional component of movement.

In a first aspect of the invention there is provided a toy, said toy comprising at least one article, and a surface along which said article is provided to move, and a control means arranged to impart a moving action to move the article along the surface, and wherein the article is provided with a movement means and said movement means is driven by the movement of the article along the surface.

In one embodiment the movement means acts as a balancing or positioning means to improve or aid the movement of the article along the surface and can in one embodiment be a wheel or set of wheels which rotate or skid along the surface.

In a further embodiment the movement means is connected to at least a portion of the article to cause said portion to move as the article moves along the surface such that movement of the article imparts movement of the said portion of the article via the movement means.

Typically the movement means is positioned in or on the article such that at least part of the same is in contact with the surface during movement of the article therealong.

In one embodiment the article and control means are provided with magnetic material to create a magnetic field between the same which field causes the article to follow the movement of the control means along the surface. In one embodiment the strength of the magnetic field is sufficient to retain the movement means in contact with the surface as the article moves along the same.

In one embodiment the movement means is a mechanical arrangement including at least one wheel or rotor in contact with the surface such that, as the article moves along the surface the wheel or rotor is arranged to rotate.

In one embodiment, members are located around the periphery of the wheel or rotor to be driven, said members forming part of the article. In one arrangement the members are caused to move between extended and retracted positions repeatedly as the wheel or rotor rotates.

In a further embodiment the movement means includes a wheel or rotor which is eccentrically mounted on a shaft in the article and on which are mounted, for pivotal movement, portions of the article. The pivotal movement is caused by the movement of the eccentrically mounted wheel or rotor as the article moves along the surface.

In a yet further embodiment, a wheel or rotor of the movable means is connected to cause rotation of a portion of the article which would rotate in the real life version of the article. The connection may be direct or, may be via gearing or any other mechanical arrangement.

In a yet further embodiment, the movement means is connected to a drive means such as a clockwork mechanism or other stored energy device such that movement of the article and causes the movement means to move the drive means and store energy which can subsequently be selectively released to cause a further component of movement of the article or other part of the toy, even when the article has ceased to move along the surface under the influence of magnetic attraction.

In a further aspect of the invention there is provided an article which is a scale model depicting an object or being such as a human, animal or machine, said article including at least one magnet in a portion arranged in use to be positioned on a surface along which the article moves under the influence of magnetic attraction and wherein the article includes a movement means which is driven as the article moves along said surface.

In one embodiment the movable means is rotatably movable and is arranged to be in contact with the surface as the article moves along the same. In one embodiment the movement means provides a balance or adds to the range or efficiency of movement of the article along the surface. In an alternative embodiment the movement means is, or is connected to, a portion of the article to impart movement thereof so that the article, while moving along the surface has a further component of movement.

In one embodiment the control means is mounted under the surface and the control means and article are provided with magnets or magnetic material and said magnets and/or magnetic material respectively arranged to create a magnetic field between the two when in proximity so that movement of the control means causes the article to follow along the surface. Typically the magnet in the control means is mounted in a housing located at the distal end from the point of actuation of the control means and, in one embodiment, articulation can be provided between the point of actuation and the distal end so as to allow the distal end of the control means to follow the underside of the playbase surface if the surface is sloped, for example.

Thus, the present invention provides movement means which are driven to move as the article moves along the surface and which in one embodiment add to the stability or efficiency of movement of the article along the surface and/or if the movement means are connected to at least one portion of the article, can be used to move the portion to create an article with animated movement as the article moves along the playbase surface Specific embodiments of the invention will now be described with respect to the accompanying drawings, wherein:

DETAILED DESCRIPTION OF THE INVENTION

Figure 1:
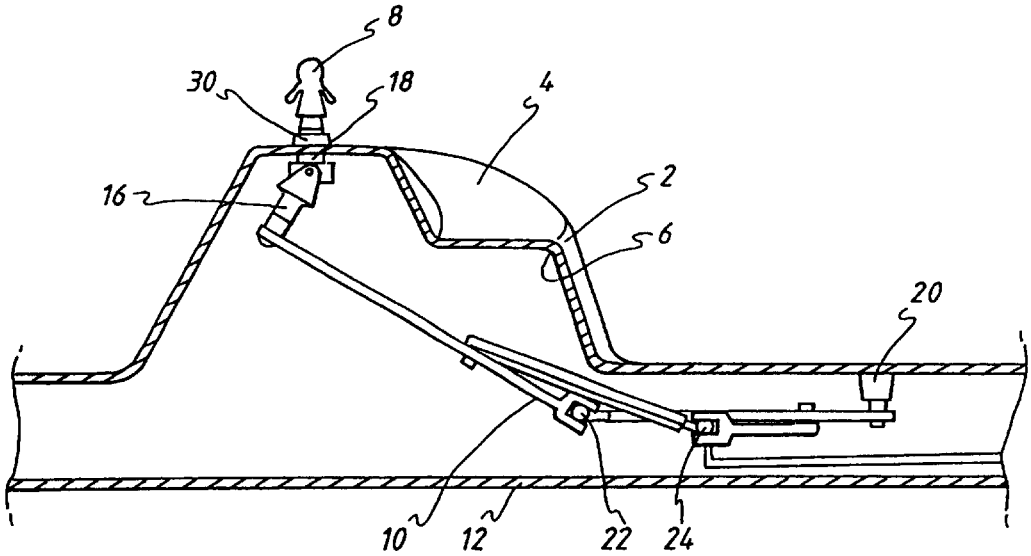
FIG. 1 shows one embodiment of a toy of the type to which the invention relates.

Referring firstly to FIG. 1 there is shown, in section, a toy according to a first aspect of the invention. The toy comprises a playbase 2 which has a top surface 4 which is shaped and an underside 6 which is shaped in substantially the same manner as the top side 4. On the top surface 4 of the playbase there is provided an article 8 which is provided to be moved along said surface. On the underside of the playbase there is provided a control means 10 which is enclosed by a panel 12.

The control means 10 in the embodiment shown comprises a series of lever members which are interconnected, and at one end there is provided a housing 16 in which a magnet 18 is mounted in a pivotal manner and at the other end of the control means there is provided an actuating means (not shown) which protrudes through the play base 2 to allow the same to be manipulated manually to cause movement of the control means relative to the playbase. The lever members arrangement is pivotally movable relative to the playbase via pin 20 and the lever members are relatively pivotal. The control means also includes ball joint pivot points 22, 24 to allow the articulation of the control means. The articulation of the control means provides the ability for the housing 16 and magnet 18 to be articulated and movable in a non planar manner to follow the shape of the underside 6 of the playbase. This movement can be assisted by the provision of guide means (not shown) formed on the underside of the playbase.

The article 8 is also provided with a magnet 30 in the base thereof and said magnet is arranged relative to the magnet 18 of the control means such that when the article is placed on the playbase and the control means magnet 18 is in proximity the article is attracted to contact with the playbase. The attraction is required to be sufficiently strong such that, when the control means magnet 18 is moved by actuating the control means, the article overcomes friction and moves under the influence of the magnetic force to follow the path of the magnet 18. In this manner the article appears to be moving independently across the playbase 2 with no external forces applied as the control means are hidden and controlled from a point remote to the article. It will be apparent that this is of particular appeal to children. In addition in the embodiment shown and as illustrated in co-pending patent application GB9718164.8 the provision of the articulated control means allows the control means magnet 18 to follow a non planar underside 6 of the playbase 2 and hence allow the magnet to be sufficiently close to the playbase to maintain the strength of the magnetic field with the magnet 30 of the article 8 such that when the magnet 18 is moved, the article follows and so the article can be moved around non-planar surfaces as shown in FIG. 1.

Figure 2:
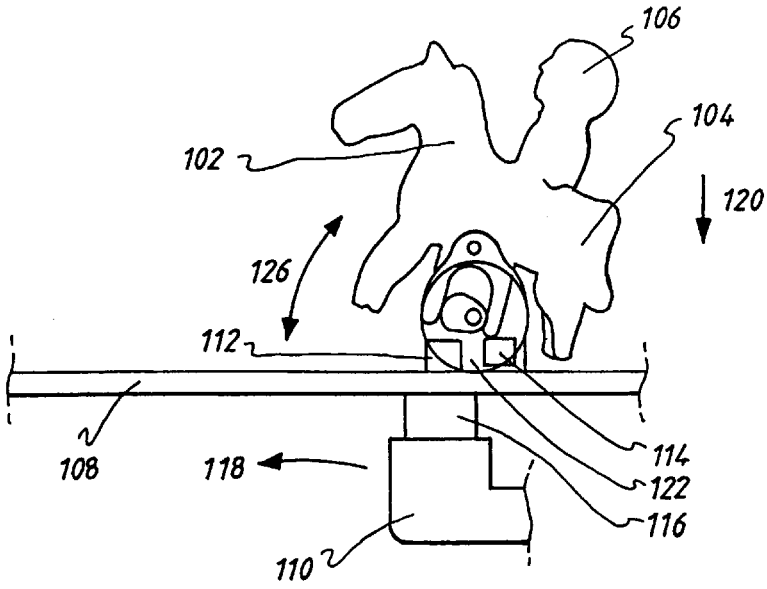
FIG. 2 illustrates an article, surface and control means according to a further aspect of the invention.

Referring now to FIG. 2, there is shown an article 102 in one embodiment of this invention. In this embodiment the article depicts a horse 104 and rider 106. The article 102 is arranged to be movable along playbase surface 108 and, under said surface there is provided a control means 110, shown in schematic fashion for the purposes of illustration.

The article 102 is provided with magnets 112, 114, with the magnet 112 being the stronger of the two and arranged to create a magnetic attraction with magnet 116 in the control means when the two are in proximity as shown in FIG. 2, such that when the control means 110 is moved such as direction 118, the article also moves in that direction under the influence of the magnetic attraction which also causes the article to be forced down into contact with the surface as indicated by arrow 120.

Figure 3:
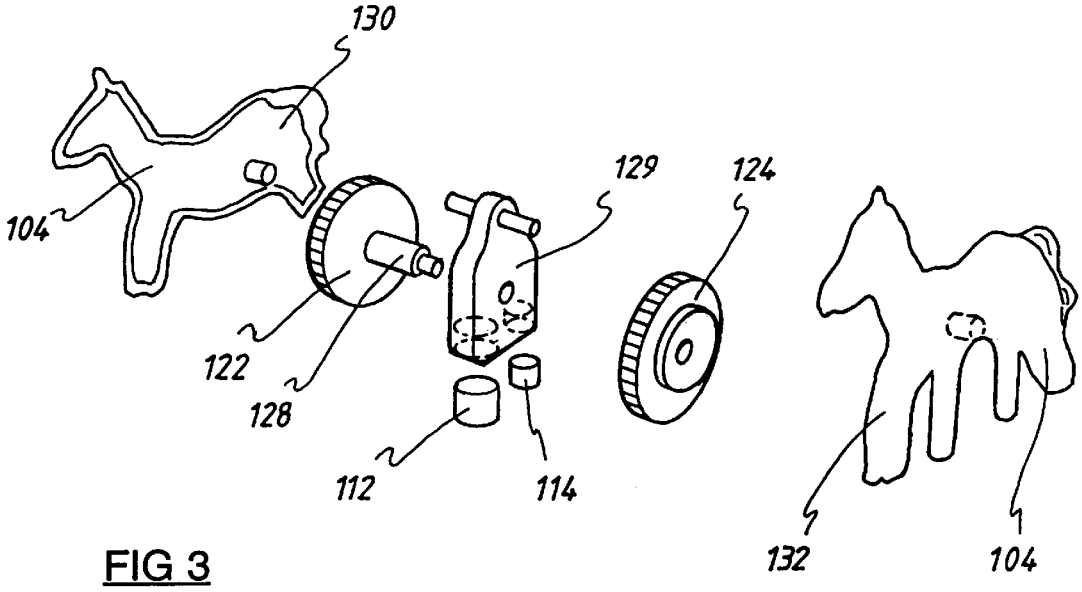
FIG. 3 illustrates an exploded diagram of the article of FIG. 2.

According to the invention the article 102 is also provided with a movement means which in this embodiment includes a wheel 122, and, as shown in FIG. 3, in this embodiment the wheel is axially mounted with an eccentric lobe 124. The wheel is arranged to be in contact with the surface 108 so that as the article moves in direction 118 the wheel is driven.

In this embodiment the movement means causes movement of the article via the eccentrically mounted lobe 124 and wheel 122 mounted on a common shaft 128. This shaft passes through bracket 129, in which, in this embodiment, the magnets are also mounted. Also provided to be pivotally mounted on the bracket are the two horse shaped sides 130, 132 of the article 104. These sides are movable in relation to the bracket 129 and so the relative movement of the lobe on wheel 124 in a slot on the side 132 in the bracket 129 causes a rocking movement 126 of the pivotally movable sides 130, 132 as the article moves along the surface 108 under the influence of the control means.

Figure 4:
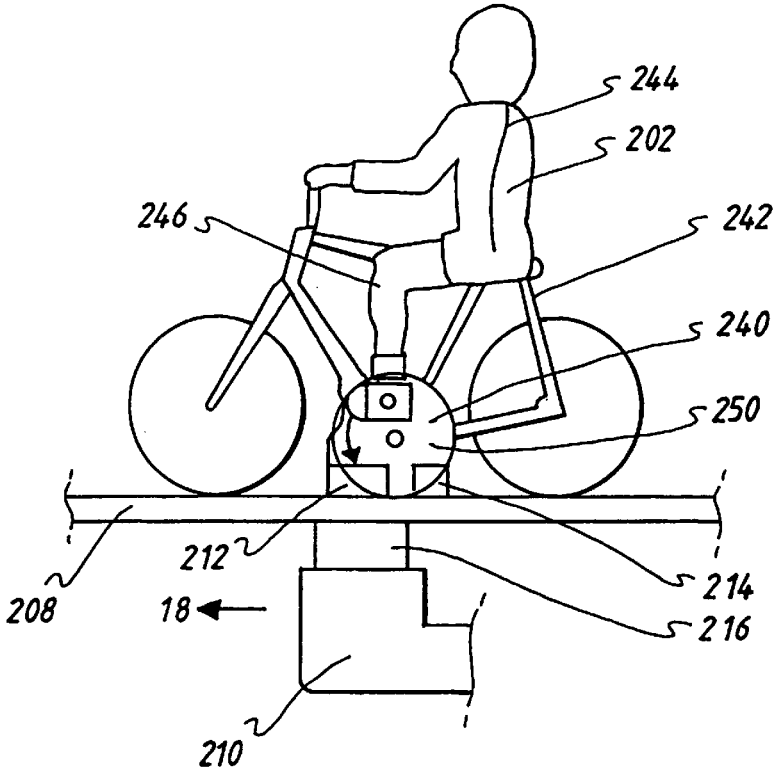
FIG. 4 illustrates an article, surface and control means according to an alternative embodiment of the invention.

FIG. 4 illustrates an alternative embodiment of the invention wherein the article 202, surface 208 and control means 210 are provided in proximity with magnets 212, 214, 216 respectively to allow movement of the article to follow the movement of the control means, However, in this embodiment, the movement means comprises a wheel or roller 240 and the article depicts a bicycle 242 and rider 244. The rider is provided with legs, one each side of the bicycle, and one leg 246 is shown. The leg 246 is formed of a flexible material and the remote, or foot end, is connected to a side face 250 of the wheel 240, at the periphery. This is repeated for the other leg, not shown, except that the "foot" is connected to the wheel at a position rotated 180° from the position of the other foot end. Thus, when the wheel rotates on contact with the surface 208, the legs are caused to move between extended and retracted positions, so as to recreate the movement of the legs of a real person riding a real bicycle.

It will readily be appreciated that this additional animation greatly adds to the realism of the article and the toy in general and to the enjoyment of the person playing with the same.

Figure 5:
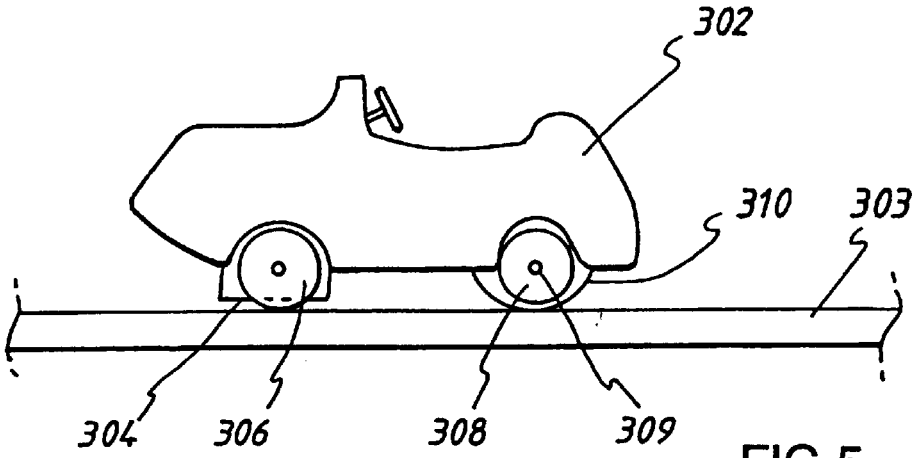
FIG. 5 illustrates a further embodiment of an article in elevation and plan according to the invention.
Figure 6:
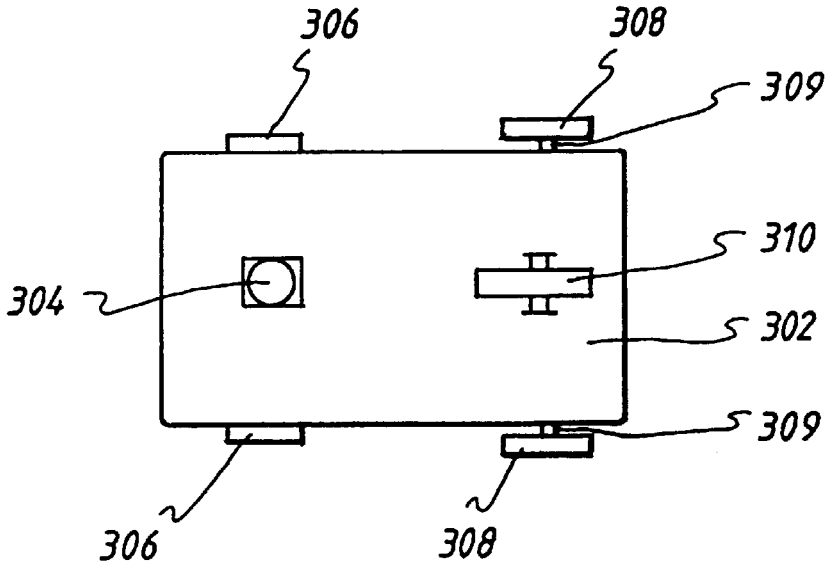
FIG. 6 illustrates the underside surface of the article of FIG. 5.

FIGS. 5 and 6 illustrate a further embodiment of the invention wherein there is shown an article 302 in the form of a scale car, and said car is provided to be moveable by control means (not shown) along surface 303 in a similar manner to that described in the preceding Figures. In this arrangement the article is provided with a magnet 304 mounted towards the front of the car and in line with the position of the depicted front wheels 306 of the car. The car is also provided with a set of rear wheels 308 and these are provided on a floating axle 309 which allows the wheels to move as they pass over an uneven surface. Intermediate the rear wheels 308 there is mounted a movement means in the form of a rotabable wheel 310. This wheel is positioned to contact with the surface as the article moves therealong. The wheel is not connected to impart any movement on portions of the car but instead acts as a means to balance the movement of the article, to stabilise the article and can also improve the ability of the article to turn around corners and the like more efficiently and realistically. This embodiment therefore illustrates how the movement means of an article in accordance with this invention can also be used to provide functional improvements to the use of the vehicle.

The aspects of this application represent significant improvements on the conventional toys of this so adding to the realism and enjoyment of the toy to the child.

What is claimed is:

1. A toy comprising:

at least one article having a first magnet;

a playbase having a plurality of paths extending along a non-planar, unbroken surface upon which said article is provided to move; and control means for imparting a moving action to move the article in an operator selected direction along a selected path of the plurality of paths, said control means mounted on an underside portion of the surface and having a first distal end with a control magnet to influence the first magnet of the article, said control magnet moveable in a non-planar manner along the underside of the playbase, and a second end spaced from the first end and extending through the surface of the playbase, said second end adapted to allow the operator to manually affect one or more of the article's movement, speed or direction along the selected path, and wherein the article is provided with movement means for causing a visual effect on said article, said movement means driven by the movement of the article along the surface.

2. The toy of claim 1 wherein the article is a scale model of an object or being, said article including at least one magnet in a portion arranged, in use, to be positioned on a surface along which the articles moves under the influence of magnetic attraction.

3. The toy according to claim 2 wherein the movement means contacts the surface as the article moves along the same.

4. The toy according to claim 2 wherein the movement means provides balance, stability or adds to the range or efficiency of movement of the article along the surface.

5. The toy according to claim 2 wherein said movement means is connected to at least one portion of the article to move the same when driven and create an article with animated movement as the article moves along the playbase surface.

6. The toy of claim 1 wherein the movement means acts as a balancing or positioning means to improve or aid the movement of the article along the surface.

7. The toy of claim 1 wherein the movement means is connected to at least a portion of the article to cause said portion to move as the article moves along the surface.

8. The toy of claim 1 wherein the movement means is positioned in or on the article such that at least part of the same is in contact with the surface during movement of the article therealong.

9. The toy of claim 1 wherein the article and control means are provided with magnetic material to create a magnetic field between the same, which field causes the article to follow the movement of the control means along the surface and retains the movement means in contact with the surface.

10. The toy of claim 1 wherein the movement means is a mechanical arrangement including at least one wheel or rotor in contact with the surface.

11. The toy of claim 10 wherein at least one portion of the article is located around the periphery of the wheel or rotor to be driven, said portion forming part of the article and caused to move between extended and retracted positions repeatedly as the wheel or rotor is driven to rotate.

12. The toy of claim 10 wherein the wheel or rotor is eccentrically mounted on a shaft in the article and on which is mounted, for pivotal movement, at least one portion of the article.

13. The toy of claim 10 wherein the wheel or rotor of the movable means is connected to cause rotation of a portion of the article, said article depicting a real life article in scaled form and which portion would rotate in the real life version of the article.

14. A toy according to claim 1 wherein the control means and article are provided with magnets or magnetic material, respectively, arranged to create a magnetic field between the article and control means through the surface when in proximity so that movement of the control means on the underside of the surface causes the article to follow along the top side of the surface.

15. A toy according to claim 14 where the control means comprises a proximal end connected to the underside portion of the surface and a distal end comprising a housing containing a magnet.

16. A toy according to claim 15 wherein the control means is articulated between the proximal end and the distal end.

* * * * *